United States Patent [19]

Smith, Jr. et al.

[11] 3,988,736

[45] Oct. 26, 1976

[54] STEERABLE FEED FOR TOROIDAL ANTENNAS

[75] Inventors: Lewis V. Smith, Jr., Bethesda; Norman P. Miller, Rockville, both of Md.

[73] Assignee: Communications Satellite Corporation (Comsat), Washington, D.C.

[22] Filed: Nov. 29, 1974

[21] Appl. No.: 528,311

[52] U.S. Cl. ..... 343/761; 343/779

[51] Int. Cl.[2] ..... H01Q 3/12

[58] Field of Search ..... 343/761, 765, 840, 779

[56] References Cited

UNITED STATES PATENTS

| | | | |
|---|---|---|---|
| 2,976,533 | 3/1961 | Salisbury | 343/761 |
| 3,273,156 | 9/1966 | Doundoulakis | 343/765 |
| 3,386,100 | 5/1968 | Jaszberenyi | 343/761 |
| 3,832,715 | 8/1974 | Afifi et al. | 343/761 |
| 3,852,763 | 12/1974 | Kreutel et al. | 343/761 |

*Primary Examiner*—Eli Lieberman

*Attorney, Agent, or Firm*—Sughrue, Rothwell, Mion, Zinn & Macpeak

[57] ABSTRACT

A plurality of steerable beam feed devices are used in combination with a single stationary toroidal antenna which permits simultaneous communication with several geosynchronous satellites. Each feed device is movably mounted on a flat elevation plate having linear bearings which mate with rails on a flat azimuth plate to allow the feed to be positioned vertically or at some angle with respect to the vertical depending upon the orientation of the antenna. The flat azimuth plate is mounted for movement on two curved rails which follow the focal arc of the toroidal antenna. Linear actuator devices are provided for moving each plate within a limited range to provide fine positioning of the feed relative to the antenna.

8 Claims, 9 Drawing Figures

36
34
32

34
36
32

24
3
4
22
36
38
5
5
26
32
6
94
92
42
30
28
96
16
4
126
6
124
40
3

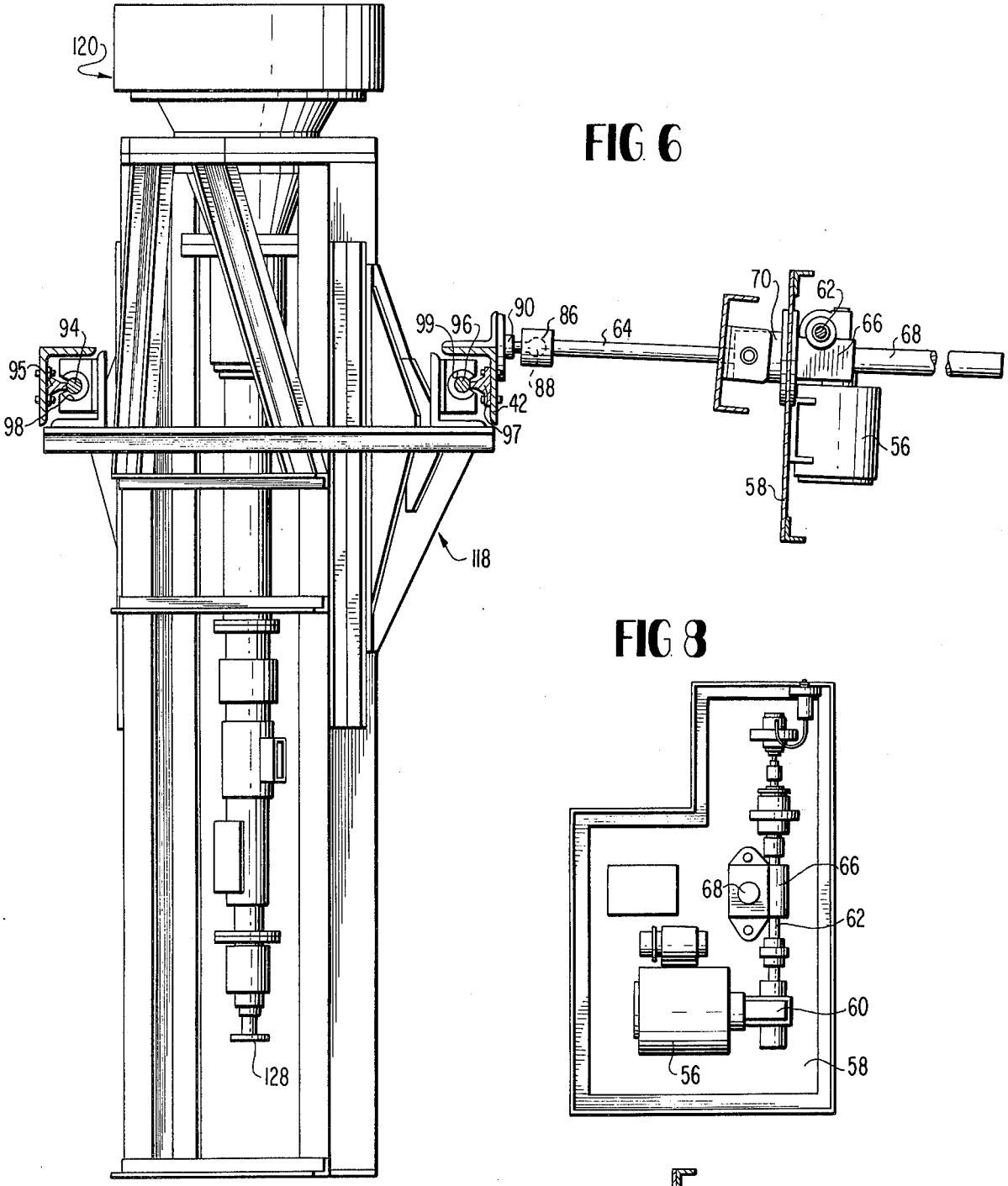
FIG. 6
FIG. 8
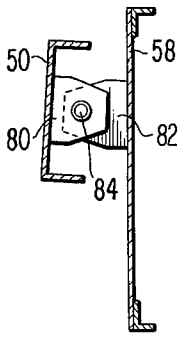
FIG. 9

STEERABLE FEED FOR TOROIDAL ANTENNAS

BACKGROUND OF THE INVENTION

1. Field of the Invention

The present invention is generally directed to a movable feed for use with a stationary toroidal antenna in communication with geosynchronous satellites and more specifically to the arrangement for supporting and moving the feed along the arc of the toroidal antenna as well as perpendicular thereto.

2. Prior Art

The standard method for tracking a synchronous satellite for communication is to use a steerable paraboloidal antenna capable of looking at the total visible sky or a large segment thereof. Since satellites can now be maintained in a position to with ±1° and closer it is not necessary to be able to steer the antenna beam for complete or nearly complete sky coverage. The satellites are set in a "parking space" in the sky which span approximately 20° of longitude. In order to steer a conventional antenna the complete structure is driven to maintain a constant optical configuration. Dead load deflections in all elevation angles must be considered to obtain an optimum acceptable surface tolerance. Dual drive motors and gears operating in a manner opposed to each other are required on each axis to steer the antenna accurately and to eliminate steering errors which would result from backlash. The drive and servo-control systems are designed to maintain accurate tracking and pointing to within 0.1 and 0.2 of the antenna beam width. The drives must be capable of driving in high winds so the antenna can be stowed to protect the structure at high survival winds.

In most prior art steerable antenna an extremely powerful drive system must be employed since the weight of the entire structure will range between 30,000 and 1,000,000 pounds depending on the type and the size of antenna used. When a steerable antenna is utilized the feed for the antenna is generally remote from the transmitting and receiving equipment or the transmitting and receiving equipment must be mounted in a moving elevated room on the conventional steerable antenna thereby adding substantially to the weight to be driven.

Furthermore, with some prior art arrangements it was necessary to utilize a separate and independent steerable antenna for communication with each satellite even when two or more synchronous satellites were stationed in the same region or "parking lot".

SUMMARY OF THE INVENTION

The present invention provides an antenna beam steering system which functions by moving only the feed rather than the entire antenna structure so that smaller bearings, drive motors and gears may be used.

The present invention provides an antenna beam steering system wherein the feed is movable relative to a stationary toroidal antenna and the drive mechanism therefor is enclosed in a protected environment so that maintenance and repair can be conveniently accomplished at any time regardless of the weather.

The present invention provides an antenna beam steering system wherein several feeds may be simultaneously mounted along the focal arc of a toroidal antenna with similar steering mechanisms to allow communication via several satellites located along the geostationary arc and within the field of view of the toroidal antenna.

The present invention provides an antenna beam steering assembly which may be disposed in a structure or housing spaced from a separate stationary toroidal antenna. A feed support adapted to support several feeds on the focal arc of the antenna is comprised of two bearing rails mounted above and below a window in said housing. The rails are curved to follow the focal arc of the toroidal reflector and a flat azimuth plate is mounted on said rails by means of motor bearings to provide hour-angle steering. Two similar straight rails are mounted on the azimuth plate and a flat elevation plate is supported on the straight rails to provide declination steering. The feed and its associated paramps and other equipments are supported on a truss structure suspended from said elevation plate. The steering of the feed is accomplished by moving the elevation and azimuth plate by means of motor driven linear actuator mechanisms connected thereto to steer the feed ±1° on each axis. A plurality of identical feeds may be mounted on the same curved rails for simultaneous communication with a plurality of geosynchronous satellites located in the same region or "parking area".

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 6 is a sectional view taken along the line 6—6 of FIG. 2 showing the arrangement of the drive for the azimuth plate and the mounting arrangement of the elevation plate and the feed on the azimuth plate.

FIG. 8 is a side elevational view of the drive arrangement of the linear actuator for the azimuth plate as viewed in a direction of the arrows 8—8 of FIG. 7.

FIG. 9 is a detailed sectional view of the pivotal arrangement between the linear actuator and the stationary frame as viewed along the line 9—9 of FIG. 7.

DETAILED DESCRIPTION OF THE INVENTION

Figure 1:
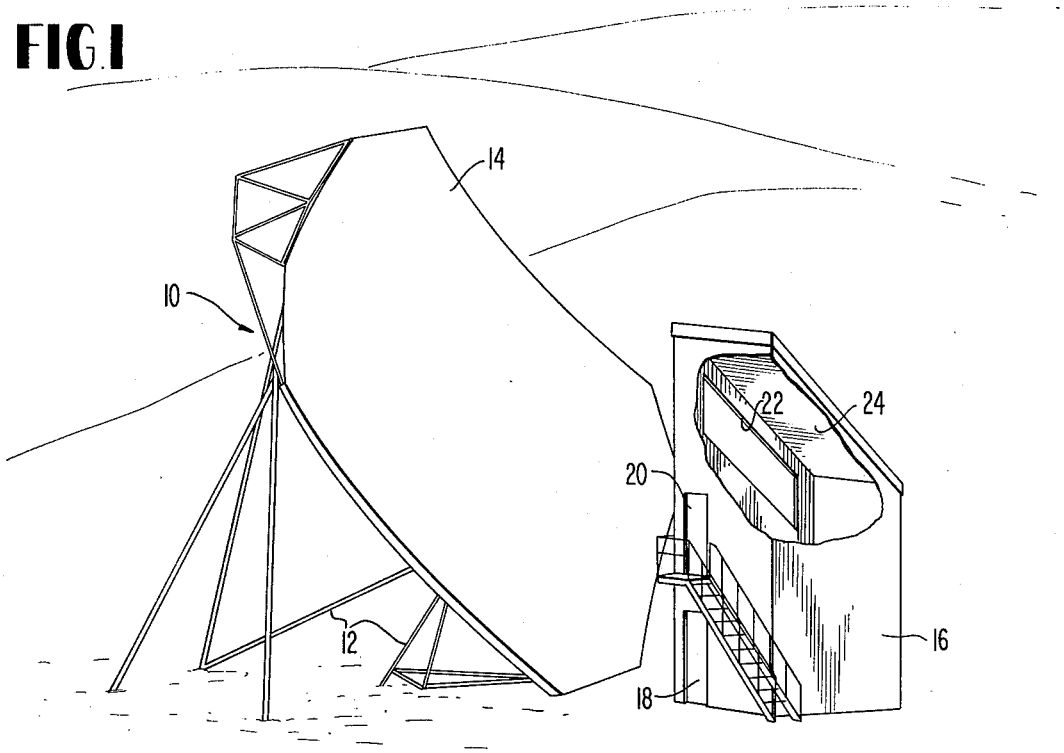
FIG. 1 is a perspective view of a ground station according to the present invention having a toroidal antenna and the housing for the feed assembly with the feed assembly omitted.

FIG. 1 is a view of a typical earth station according to the present invention which is comprised of a stationary toroidal antenna and the housing spaced from the face of the antenna for containing the movable feed assemblies for communicating with a plurality of geosynchronous earth satellites located in substantially the same region. The reflector 10 is comprised of a supporting structure generally indicated at 12 and a reflecting surface 14 having a non-rectangular toroidal configuration defined by the rotation of a smooth generating curve which is not an arc of a circle about an axis which is disposed at an angle not equal to 90° to the axis of beam direction of a reflected beam. The details of the construction of the antenna, other than the shape of the reflecting surface 14 do not form a part of the present invention and therefore are not described in detail.

The housing 16 for the steerable feed, which has not been shown in FIG. 1 for the sake of clarity, is comprised of a two-story structure having an equipment room on the ground floor accessible through the door 18 and the steerable feed assembly room on the second floor accessible through the door 20. The wall of the housing 16 facing the reflector surface 14 is provided with a window 22 which is at least 40 inches wide and runs just below and parallel to the sloping roof 24 of the structure 16. The roof slope is determined by the tilt of the reflector 14 which is set by the satellite geostationary arc as seen from the antenna location.

Figures 2, 4, 5:
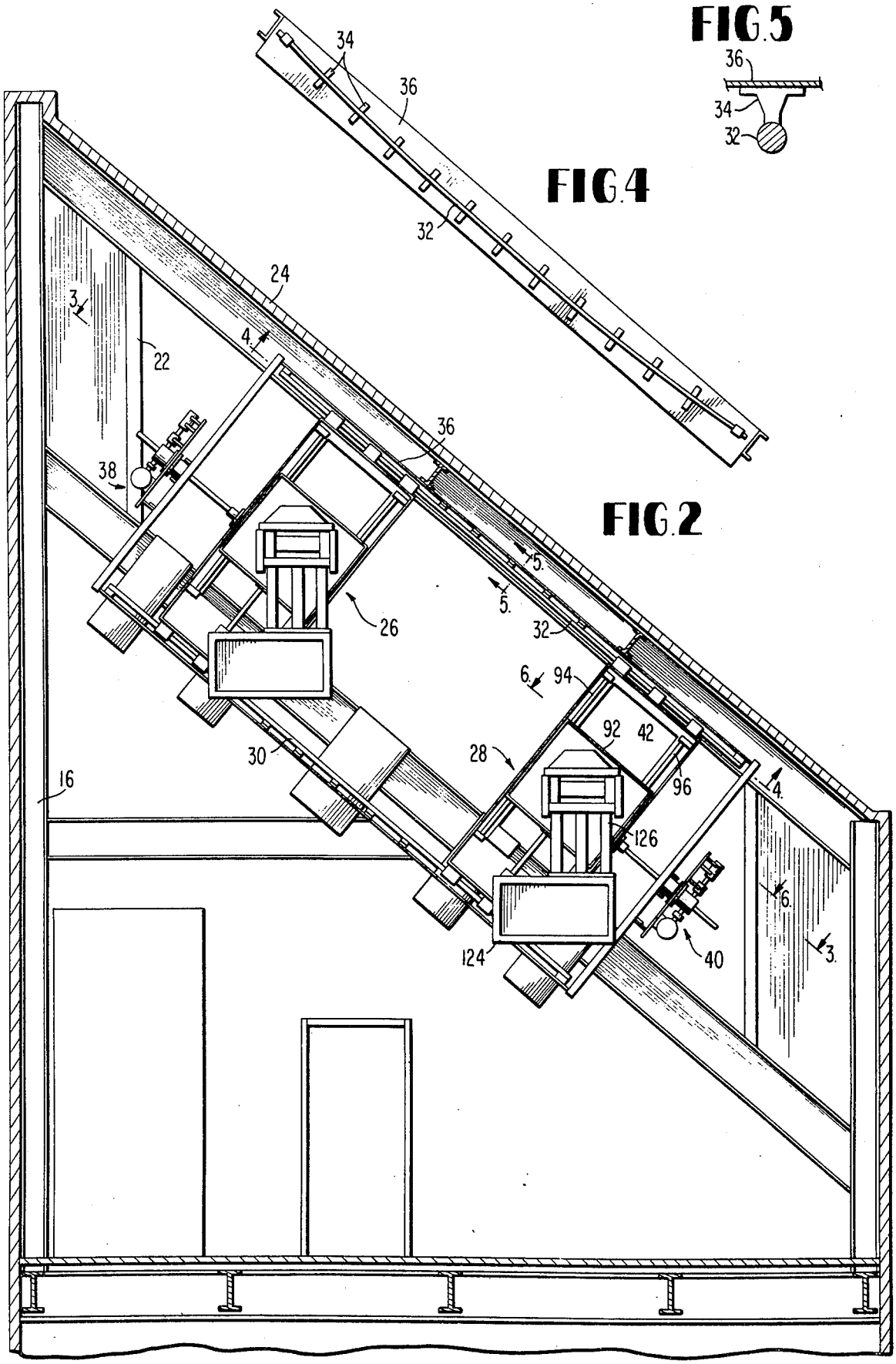
FIG. 2 is a sectional elevational view of the housing in FIG. 1 showing the arrangement of two feed assemblies therein.
FIG. 4 is a sectional view taken along the line 4—4 of FIG. 2 with the bearing elements eliminated to show the curved configuration of the rail.
FIG. 5 is a sectional view taken along the line 5—5 of FIG. 2 to show how the curved rail is mounted on the housing.

FIG. 2 shows a view of the wall of the housing 16 which faces the antenna from the inside with two substantially identical steerable feed assemblies 26 and 28 mounted for movement in the window opening 22. The window opening 22 may be covered with any suitable material such as plastic or the like which will not interfere with the beam transmission. Two curved support rails 30 and 32 are mounted above and below the window 22 and extend parallel thereto. The guide rails 30 and 32 are comprised of solid stainless steel rods which are firmly supported along a circular arc having its center coincident with the axis of rotation of the toroidal reflector 14. As best shown in FIGS. 4 and 5 the rod or guide rail 32 is secured to a plurality of supports 34 by means of welding or the like at closely spaced intervals to provide an extremely stable guide rail. The supports 34 are in turn secured to a support plate 36 by any suitable means such as welding and the support plate 36 is mounted directly on the frame of the housing 16. The lower guide rail 30 is constructed and mounted in a manner substantially identical to the manner of the upper guide rail 32 and has the exact same curvature as the upper guide rail 32.

The two steerable feed assemblies 26 and 28 shown in FIG. 2 are substantially identical except for the location of the linear actuator for each assembly for moving the assemblies along the guide rails 30 and 32. As shown in FIG. 2 the linear actuator assembly 38 is located on the left hand side of the assembly 26 whereas the linear actuator mechanism 40 is located on the right hand side of the assembly 28 so that the linear actuator mechanisms will not interfere with each other. Since the assemblies 26 and 28 are substantially identical in all other respects only a detailed description of the assembly 28 will be set forth in detail.

Figure 7:
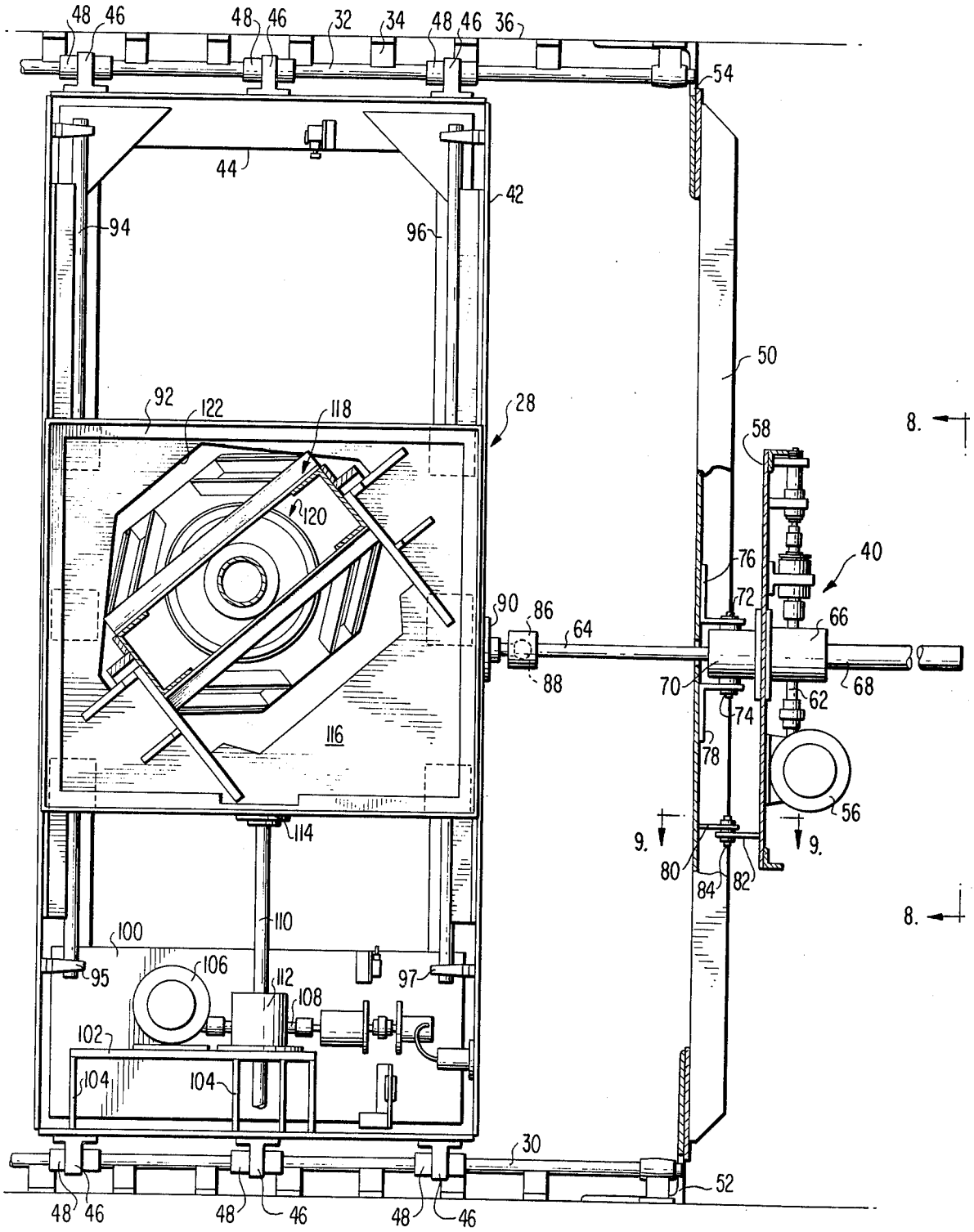
FIG. 7 is an end elevational view of a feed assembly, partly in section, as viewed from inside the housing structure.

In describing the steerable feed mechanism 28 in detail, specific reference will be made to FIGS. 6 and 7 which show the assembly 28 in greater detail. A rectangular frame 42 having a central substantially rectangular opening 44 is provided with a plurality of U-shaped support brackets 46 at the top and bottom ends thereof each of which carries a bearing sleeve 48 which engages about the top and bottom guide rails 32 and 30 with clearance for the guide rail supports 34. The plate or frame 42 which is referred to as the azimuth frame is adapted to be moved along the guide rails 32 and 30 to compensate for the daily motion of several degrees in azimuth or hour-angle by means of the linear actuator mechanism 40. A channel-shaped support bar 50 is secured to the frame of the housing 16 at the right hand ends of the guide rails 30 and 32 by means of L-shaped mounting brackets 52 and 54. A small AC motor 56 is mounted on a support plate 58 and the motor shaft 60 is coupled to a drive shaft 62 disposed at a right angle thereto by means of any suitable angle gearing such as worm gearing or the like. The drive shaft 62 is arranged to impart reciprocating movement to the linear actuator shaft 64 which is disposed orthogonal relative thereto by means of a further worm drive arrangement or the like. The worm gearing is disposed within a protective housing 66 having a closed hollow tubular extension 68 for receiving the shaft 64 when the shaft 64 is shifted to the right as viewed in FIG. 6. An additional protective sleeve 70 is provided for the shaft 64 on the opposite side of the support plate 58 and suitable seals may be provided where the shaft 64 exits from the sleeve 70. Thus the worm gearing and the guide bearings for the shaft 64 are disposed in a sealed protected environment.

A pair of oppositely disposed trunnions 72 and 74 are mounted on the sleeve 70 for pivotally mounting the sleeve 70, as well as the entire linear actuator mechanism 40, on a pair of L-shaped brackets 76 and 78 secured to the support bar 50. One or more additional hinges may be provided for pivotally connecting the support plate 58 to the support bar 50. Such additional hinges would be comprised of a pair of protruding ears 80 and 82 secured to the support bar 50 and the support plate 58, respectively. Each ear is provided with an aperture through which a common pivot means 84 extends in axial alignment with the pivot axis of the trunnions 72 and 74.

The free end of the shaft 64 is provided with a socket 86 and a complementary ball 88 which is rigidly mounted on a support member 90 which in turn is secured to the azimuth plate or frame 42. Thus the ball and socket joint will provide a universal joint to compensate for the non-linear movement of the azimuth frame 42 along the curved guide rails 30 and 32.

The elevation plate or frame 92 is mounted for movement on the azimuth plate 42 orthogonal to the movement of the azimuth plate. The elevation frame 92 is mounted on a pair of straight steel rods 94 and 96 which are mounted on opposite sides of the azimuth frame 42 by means of brackets 95 and 97, respectively, in the same manner in which the curved rods 30 and 32 are supported on the frame of the housing. A plurality of bearing sleeves 98 and 99 are mounted along opposite edges of the elevational frame 92 for sliding engagement with the rods 94 and 96, respectively.

Along the bottom edge of the azimuth frame 42 a support plate 100 is secured by any suitable means. An outwardly protruding ledge 102 is mounted on the face of the support plate 100 by means of suitable bracket 104 and a small AC motor 106 is mounted on the ledge 102. The output shaft (not shown) of motor 106 is drivingly coupled to the shaft 108 which in turn is operably coupled to a linear actuator shaft 110 by any suitable means such as worm gearing or the like (not shown) for imparting a reciprocating drive to the shaft 110. The motor 106 is reversible as was the motor 56 so that the linear actuator shafts 110 and 64 respectively can be moved in opposite directions. The shaft 110 is guided for reciprocating movement within the housing 112 by any suitable bearing means and the end of the shaft 110 below the ledge 102 could be enclosed in a closed hollow tubular sleeve similar to the sleeve 68. The opposite end of the shaft 110 is connected directly to a drive plate 114 which in turn is operably coupled with the elevation frame 92 to impart movement thereto. It is not necessary to provide the ball and socket connection between the linear actuator shaft 110 and the drive plate 114 as was done in the drive of the azimuth frame since the elevation frame 92 travels in a straight line along straight guide rails or rods 94 and 96.

An aperture support plate 116 is secured within the elevation frame 92 and the support frame, generally indicated at 118, for the horn feed, generally indicated at 120, is mounted and secured in the aperture 122 of the plate 116 by any suitable means such as welding or the like. The orientation of the aperture 122 and the plate 116 will vary for each structure at different earth stations in the same manner in which the slope of the roof of the structure varies. A rack 124 for the paramps and other electrical support equipment is secured to the frame 118 by vertically depending supports 126. This rack has been omitted from the views shown in FIGS. 6 and 7 for the sake of clarity but is clearly shown in FIG. 2. Suitable power supply and other signal cables (not shown) would be secured to the end 128 of the horn feed assembly 120 with sufficient slack to accommodate the movement of the feed in elevation as well as azimuth directions. The exact details of the horn feed 120, the supporting frame work 118 and the supporting electrical apparatus and connection have not been shown and described in detail since they are not necessary for an understanding of the present invention which resides in the means for mounting and indexing the feed relative to the supporting structure to compensate for satellite drift. Likewise, the control signals for controlling the operation of the motors 56 and 106 are not considered to be part of the present invention and the detailed control circuitry has not been shown.

Figure 3:
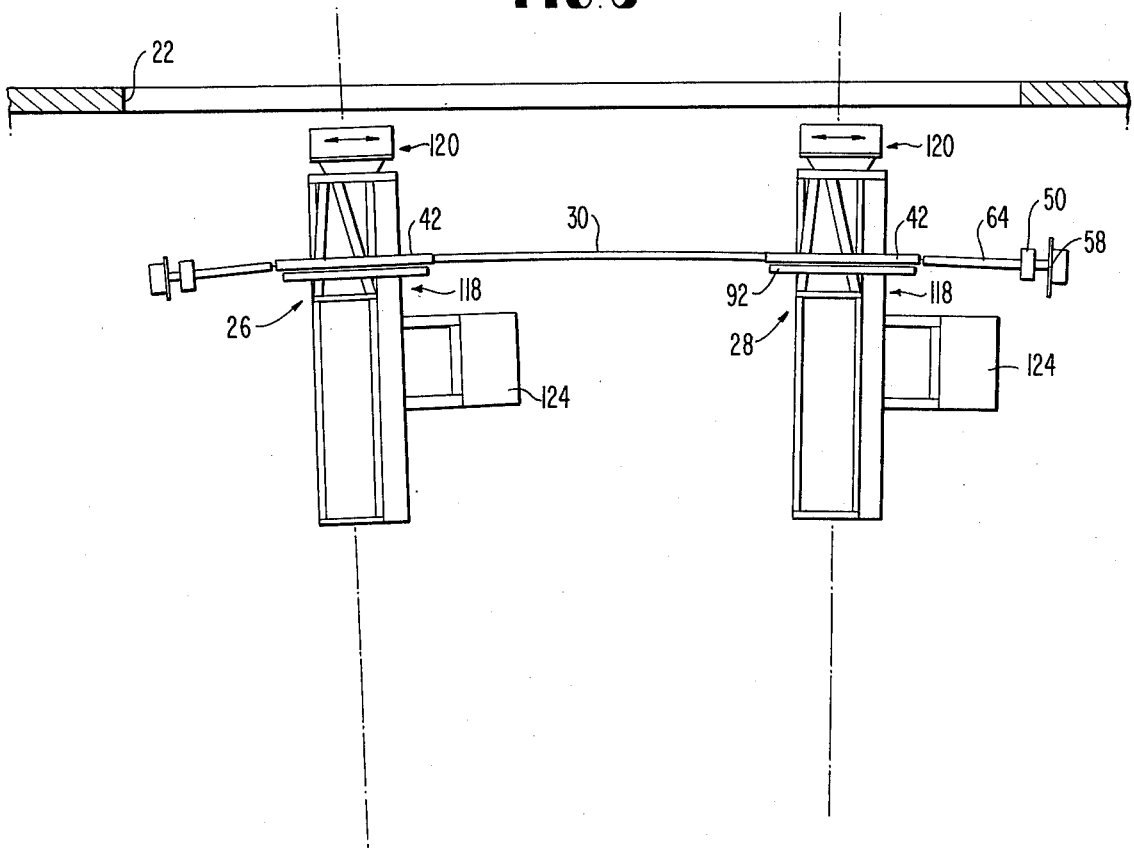
FIG. 3 is a sectional view along the line 3—3 of FIG. 2 with some elements omitted in order to show the relationship of the beam units relative to the window of the housing in plan view.

As best seen in FIGS. 2 and 3 two feed assemblies 26 and 28 have been mounted for movement on the curved rails 30 and 32. An additional feed assembly could be mounted intermediately the two feed assemblies without necessitating an increase in the length of the guide rails 30 and 32 or a change in the dimensions of the building structure 16. By using the rigidly supported guide rods and the linear actuator arrangement having a fractional horse power motor for the elevation plate and the azimuth plate it is possible to provide fine positioning of the feed in a range of $\pm 1°$ with respect to declination angles and along the arc with respect to hour-angle, respectively. By moving only the feed instead of the entire antenna structure it is possible to use smaller bearings, drive motors and gears and the drive mechanism is completely enclosed in a protected environment so that maintenance and repair can be conveniently accomplished at any time regardless of the weather. Provisions may be made for initially adjusting the feed toward and away from the reflector to coincide with the focal point but once the feed is adjusted to its focal point it remains fixed throughout all subsequent movement of the feed by the movement of the elevation and azimuth plates. The feed can be remotely positioned using the communication signal as a reference for peaking the signal. If one of the feed assemblies is to be moved to another satellite it would be possible to relocate the linear actuator support and shift the whole mechanism along the focal arc to the new position.

While the invention has been particularly shown and described with a reference to a preferred embodiment thereof it would be understood by those in the art that various changes in form and details may be made therein without departing from the spirit and scope of the invention.

What is claimed is:

1. A steerable feed for a stationary toroidal antenna having a circular focal arc comprising a stationary support structure spaced from and independent of said antenna, a pair of spaced apart parallel curved guide rails mounted on said structure along an arc parallel to the focal arc of the antenna, at least one antenna feed assembly mounted on said curved guide rails comprising first frame means movably mounted on said curved guide rails, first actuator means for selectively moving said first frame means in opposite directions along said curved guide rails, a pair of spaced apart parallel straight guide rails mounted on said first frame means orthogonal to said curved guide rails, second frame means movably mounted on said straight guide rails, second actuator means for selectively moving said second frame means in opposite directions along said straight guide rails and feed means for said antenna mounted on said second frame means.

2. A steerable feed for a stationary toroidal antenna as set forth in claim 1 wherein said first actuator means is comprised of a motor operated linear actuator having a shaft mounted for reciprocating movement therein, first pivot means for pivotally mounting said actuator on said support structure and second pivot means for pivotally connecting said shaft to said first frame means to compensate for the curved path of movement of said first frame means.

3. A steerable feed for a stationary toroidal antenna as set forth in claim 1 wherein said second actuator means is comprised of a motor driven linear actuator mounted on said first frame means and having a reciprocatable shaft slidably mounted therein and connected to said second frame means.

4. A steerable feed for a stationary toroidal antenna as set forth in claim 1 wherein a plurality of said antenna feed assemblies are mounted on said curved guide rails each of which is adapted for simultaneous use with said antenna for simultaneous communication with a plurality of synchronous earth satellites.

5. A steerable feed for a stationary toroidal antenna as set forth in claim 1 wherein said curved guide rails and said straight guide rails are comprised of solid steel rods and further comprising a plurality of spaced apart support members secured to said support structure and to said rods at points disposed in a straight line on one side of said rods and bearing means secured to said first and second frame means and disposed in partial surrounding relationship with respect to said rods.

6. A satellite communication earth station comprising a stationary non-rectangular toroidal antenna having a circular focal arc lying in the geostationary plane of a synchronous earth satellite and a steerable feed means including at least one feed assembly, for communication with a satellite, curved guide rail means for guiding said feed assembly along a circular path parallel to and spaced from said focal arc and drive means for moving said assembly along said circular path.

7. A satellite communication earth station as set forth in claim 6 further comprising additional guide means for guiding said assembly along a straight path orthogonal to said circular path and additional drive means for moving said assembly along said straight path.

8. A satellite communication earth station as set forth in claim 7 further comprising at least one additional feed assembly mounted on said guide means for movement along said circular path for communication with at least one additional satellite.

* * * * *